US008474657B2

(12) United States Patent
Szekely

(10) Patent No.: US 8,474,657 B2
(45) Date of Patent: Jul. 2, 2013

(54) POUR SPOUT

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 638 days.

(21) Appl. No.: 12/594,420

(22) PCT Filed: May 30, 2008

(86) PCT No.: PCT/US2008/065365
§ 371 (c)(1),
(2), (4) Date: Oct. 2, 2009

(87) PCT Pub. No.: WO2008/151048
PCT Pub. Date: Dec. 11, 2008

(65) Prior Publication Data

US 2010/0116776 A1 May 13, 2010

Related U.S. Application Data

(60) Provisional application No. 60/941,059, filed on May 31, 2007.

(51) Int. Cl.
*B65D 41/00* (2006.01)

(52) U.S. Cl.
USPC ..... 222/111; 222/566; 222/153.1; 215/329

(58) Field of Classification Search
USPC ... 222/566, 153.09, 153.1, 109, 111; 215/329
See application file for complete search history.

(56) References Cited

U.S. PATENT DOCUMENTS

| | | | | |
|---|---|---|---|---|
| 2,601,039 | A * | 6/1952 | Livingstone | 222/109 |
| 3,706,401 | A * | 12/1972 | Gach | 222/153.1 |
| 3,833,150 | A * | 9/1974 | Visser-Patings | 222/109 |
| 4,078,700 | A * | 3/1978 | Hidding | 222/109 |
| 4,696,416 | A * | 9/1987 | Muckenfuhs et al. | 222/109 |
| 4,706,829 | A | 11/1987 | Li | |
| 4,917,268 | A * | 4/1990 | Campbell et al. | 222/109 |
| 4,917,269 | A * | 4/1990 | Fuchs et al. | 222/109 |
| 4,917,270 | A * | 4/1990 | Simon | 222/111 |
| 5,657,905 | A * | 8/1997 | Glynn | 222/153.1 |
| 5,794,803 | A * | 8/1998 | Sprick | 215/217 |
| 6,116,477 | A | 9/2000 | Kreiseder et al. | |
| 7,222,754 | B2 * | 5/2007 | Ho | 222/153.1 |
| 8,011,535 | B2 * | 9/2011 | Tauber et al. | 222/109 |
| 2005/0103803 | A1 * | 5/2005 | Hung et al. | 222/109 |
| 2007/0194047 | A1 * | 8/2007 | Tauber et al. | 222/109 |

FOREIGN PATENT DOCUMENTS

| | | | |
|---|---|---|---|
| JP | 56-024461 | U | 3/1981 |
| JP | 2004-210354 | A | 7/2004 |

OTHER PUBLICATIONS

International Search Report for PCT/US2008/065365, dated Nov. 25, 2008.

* cited by examiner

*Primary Examiner* — Paul R Durand
*Assistant Examiner* — Donnell Long
(74) *Attorney, Agent, or Firm* — Bachman & LaPointe, P.C.

(57) ABSTRACT

In a bottle spout fitment (24) and cap (26) combination, the cap (26) has a removed condition disengaged from the spout fitment and an installed condition mounted to the spout fitment. The cap has a plurality of radially-protruding lugs (132). The spout fitment has a spout (60) and a plurality of channels (118) positioned to receive the lugs (132) in the installed condition to block a longitudinal extraction of the cap from the spout fitment.

23 Claims, 5 Drawing Sheets

POUR SPOUT

CROSS-REFERENCE TO RELATED APPLICATION

Benefit is claimed of U.S. Patent Application Ser. No. 60/941,059, filed May 31, 2007, and entitled "POUR SPOUT", the disclosure of which is incorporated by reference herein as if set forth at length.

BACKGROUND OF THE INVENTION

The invention relates to containers. More particularly, the invention relates to pour spouts for containers for liquid laundry detergent and the like.

There has been an evolution in the configuration of containers for liquid laundry detergent, fabric softener, and the like. The dominant form of container is a wide mouth bottle having an attached spout with a drain-back trough and aperture. In a typical group of container configurations and their methods of assembly, a bottle, spout fitment, and cap are individually molded (e.g., of high density polyethylene (HDPE)). Exemplary bottle molding is via roto-molding whereas exemplary spout fitment and cap molding are by injection molding. An exemplary spout fitment includes the spout and a continuation of the spout defining the base and outboard wall of the trough. The fitment further typically includes a flange (e.g., extending outward at an upper end of the outboard extremity of the trough).

The spout fitment may be inserted through a mouth of the bottle (e.g., so that an outer surface of the outboard trough wall whereof another wall outboard thereof engages the inner surface of the bottle neck). The spout fitment may be secured and sealed to the bottle such as by spin welding. The bottle may be filled and the cap may be installed. Exemplary caps typically have either an externally threaded skirt for engaging an internally threaded portion of the fitment or an internally threaded skirt for engaging an externally threaded portion of the fitment or bottle neck. With a typical externally threaded skirt, the cap includes an outwardly projecting flange above the skirt. Upon installation of the cap to the fitment, the flange underside contacts and seals with the fitment flange upper surface to seal the bottle.

Various examples of bottles are shown in U.S. Pat. Nos. 6,923,341, 5,941,422, 5,566,862, and 5,603,787.

SUMMARY OF THE INVENTION

One aspect of the invention involves a bottle spout fitment and cap combination. The cap has a removed condition disengaged from the spout fitment and an installed condition mounted to the spout fitment. The cap has a plurality of radially-protruding lugs. The spout fitment has a spout and a plurality of channels positioned to receive the lugs in the installed condition to block a longitudinal extraction of the cap from the spout fitment.

The spout fitment may be combined with a container having a body with a body opening. The spout fitment is mounted within the body opening.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
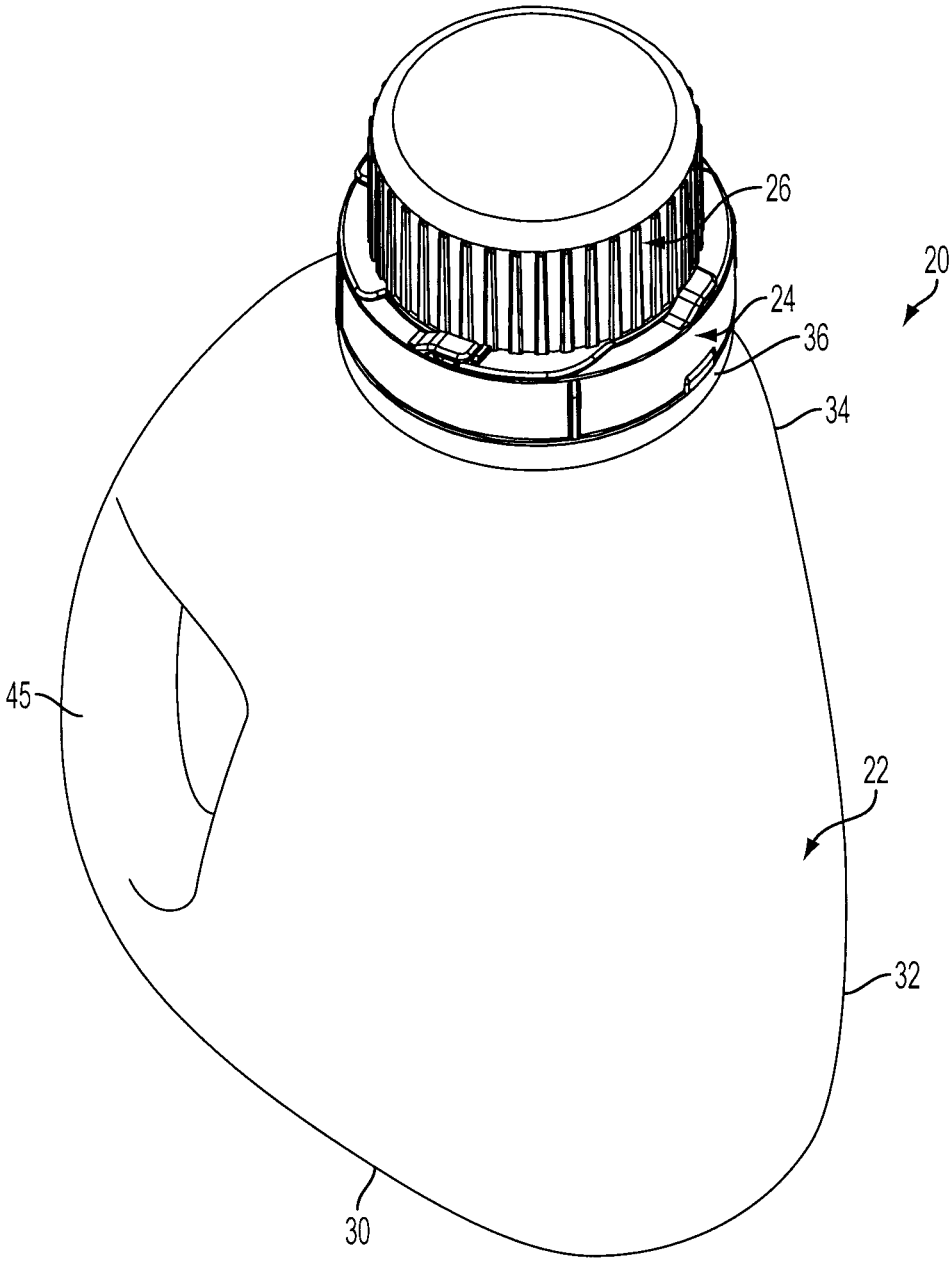
FIG. 1 is a view of a bottle.

FIG. 1 shows a container 20 comprising the assembly of a bottle body 22, a spout fitment 24, and a cap 26 (which may serve as a measuring/dispensing cup). Each may be made as a unitary plastic molding. Exemplary bottle body material is high density polyethylene (HDPE). Exemplary spout fitment and cap material is polypropylene.

Figure 4:
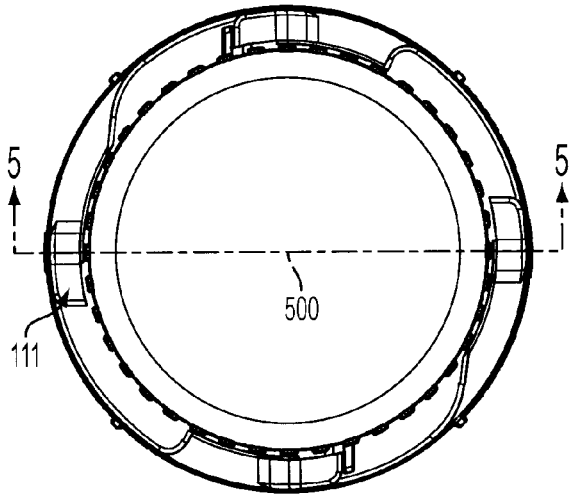
FIG. 4 is a top view of the assembly of FIG. 2.

The body 22 comprises a unitary combination of a base 30, a sidewall 32 extending upward from the base, a shoulder 34 at an upper end of the sidewall, and a neck 36 extending upward from the shoulder. The neck 36 extends to a rim 38 (FIG. 6) and defines an opening 40 having a central longitudinal axis 500 (FIG. 4). The bottle body has an interior surface 42 (FIG. 6) and an exterior surface 44. A handle 45 (FIG. 1) may extend from the sidewall and the body interior may extend through the handle.

Figure 2:
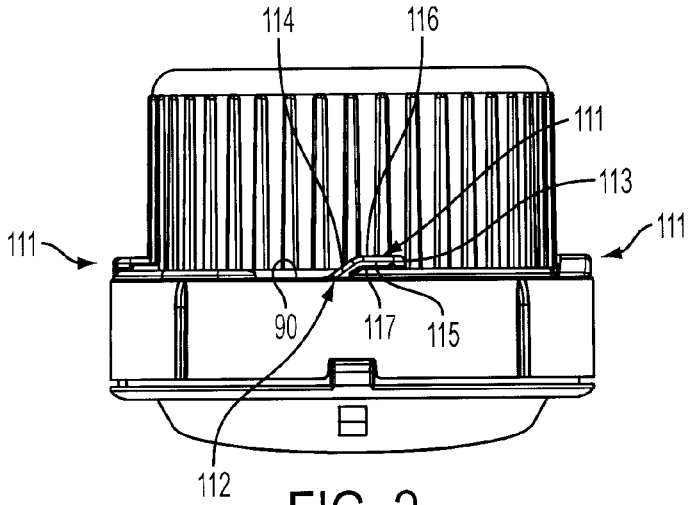
FIG. 2 is a rear view of an assembly of a spout fitment, cap, and bottle neck of the bottle of FIG. 1.

The neck 36 has an external thread 46 (FIG. 6) along a portion 48 below the rim 38. Below the portion 48, the neck has a flange 50 (FIG. 2). A pair of lugs 52 extend upward from the flange 50 partially along the portion 48. Each lug 52 has first and second circumferential ends/faces/surfaces 54 and 55. As is discussed below, the flange threads help retain the spout fitment to the neck while the lugs 52 help angularly orient the spout fitment about the axis 500.

Figure 5:
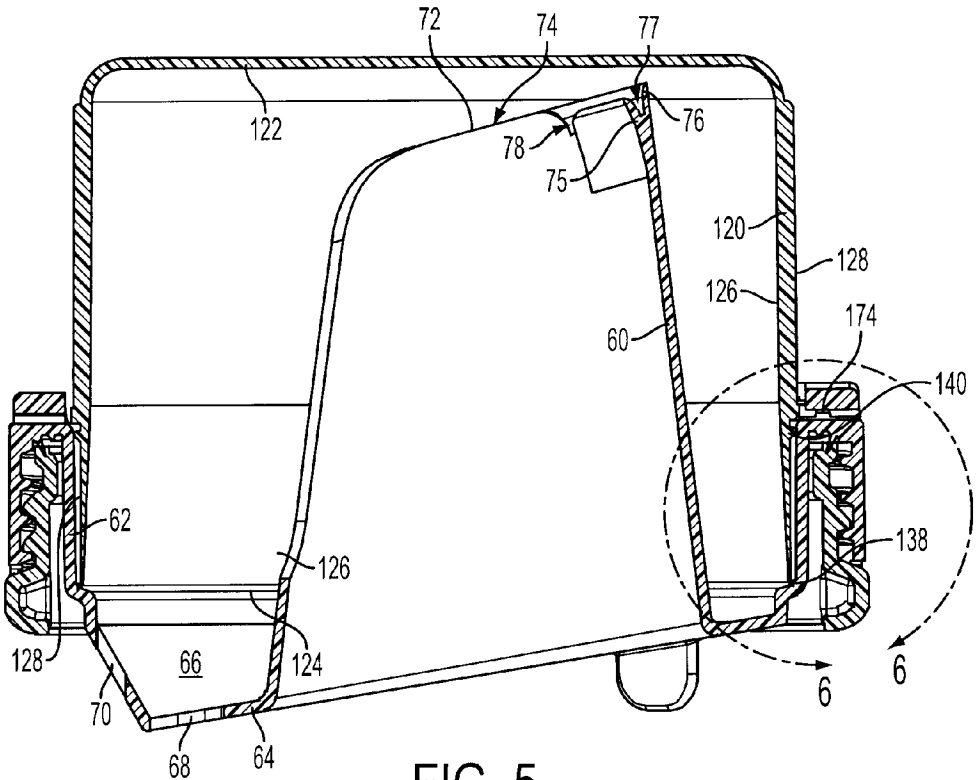
FIG. 5 is a sectional view of the assembly of FIG. 4, taken along line 5-5.
Figure 7:
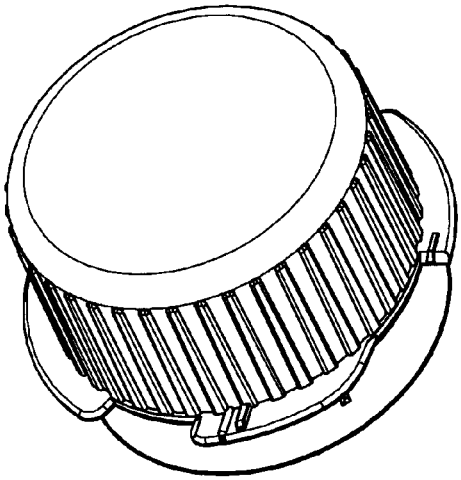
FIG. 7 is a view of a cap of the assembly of FIG. 2.
Figure 8:
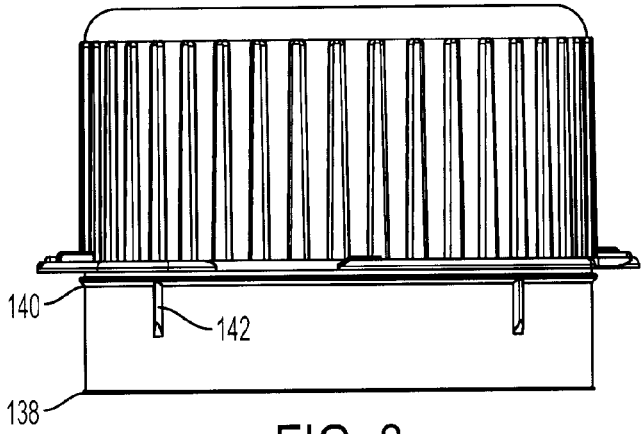
FIG. 8 is a side view of the cap of FIG. 7.

The spout fitment 24 includes an inner wall 60 (FIG. 5) and an intermediate wall or inner sidewall 62 joined by a lower or base wall 64 so as to define a drain-back trough/channel 66. One or more drain-back apertures 68 along the trough base and/or vents 70 thereabove are open to the trough (e.g., through the wall 64 and sidewall 62, respectively). To define a spout, the inner wall 60 has an upper end 72 defining a spout opening 74. The upper end 72 peaks along a forward portion and dips along a rearward portion so that the opening 72 is asymmetric and defines a preferential direction for pouring. The exemplary spout fitment has a double wall at a forward end of the spout opening 74. An inner wall portion 75 is separated from an outer wall portion 76 by a gap 77 especially when beginning and ending pouring, the separation reduces the tendency of detergent to wick or drip onto the outer surface of the outer wall. Detergent wicking or dripping onto the outer surface of the inner wall accumulates in the channel.

At the end of pouring, when the spout is upright, this may drain-back through recesses/gaps 78 at lateral ends of the inner wall.

Figure 6:
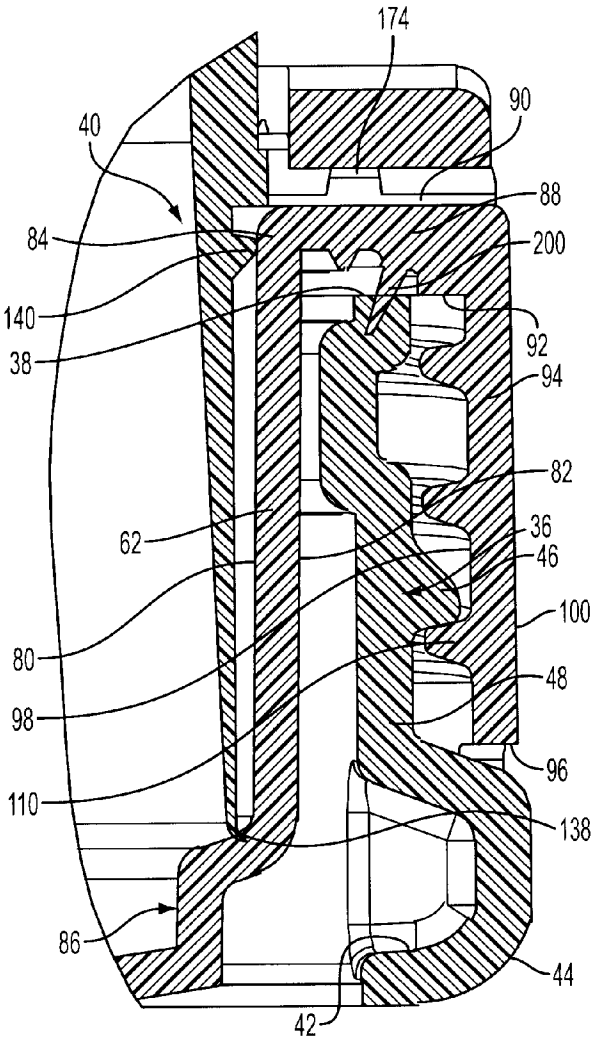
FIG. 6 is an enlarged view of a portion of the assembly of FIG. 5.

The spout fitment sidewall 62 has an inboard surface 80 (FIG. 6). The sidewall 62 has an external/outboard surface 82. The sidewall has an upper end 84 and a lower end 86. An annular upper wall 88 extends outward from the upper end 84. The upper wall 88 has an upper surface 90 and a lower surface 92.

Figure 3:
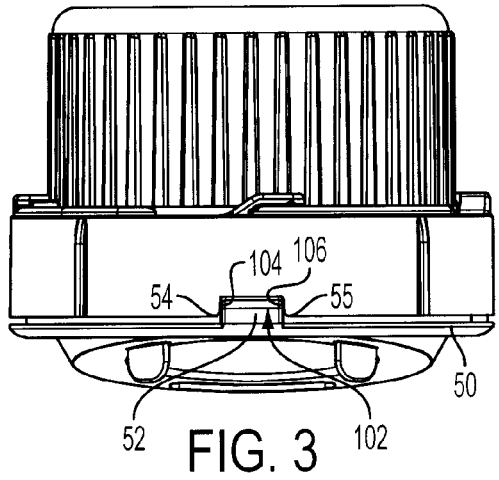
FIG. 3 is a front view of the assembly of FIG. 2.

An outer sidewall (outer wall) 94 depends from an upper end at an outboard periphery of the upper wall 88 to a lower end/rim 96. The outer sidewall 94 has an inboard surface 98 and an outboard surface 100. A pair of recesses 102 (FIG. 3) extend upward from the rim 96. Each recess 102 has first and second sides 104 and 106. As is discussed further below, each recess 102 captures an associated neck lug 52 so that adjacent surfaces of the recess and neck lug angularly retain the spout fitment relative to the neck.

The inboard surface 98 bears an internal thread 110. As is discussed below, whereas the recess 100 functions to orient the spout fitment on the body, the thread 110 cooperates with the external thread 46 in retaining the spout fitment to the body.

Figure 12:
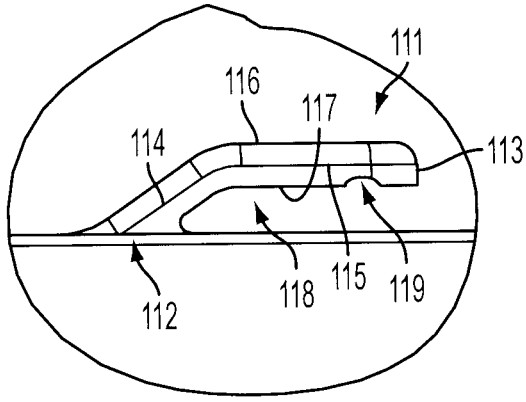
FIG. 12 is an enlarged view of a rim portion of the spout fitment of FIG. 11.

A plurality of arms 111 (FIG. 2) extend from proximal ends 112 at the upper wall upper surface 90 to distal ends 113. The arms have partially upwardly extending proximal portions 114 and an approximately circumferentially/radially extending distal portions 115. Each arm has an upper surface 116 and a lower surface 117. The lower surface 116 cooperates with the upper wall upper surface 90 to define a channel 118 (FIG. 12) for receiving a lug of the cap (described below). The lower surface includes a detent recess 119 for receiving a complementary detent projection of the lug.

Figure 9:
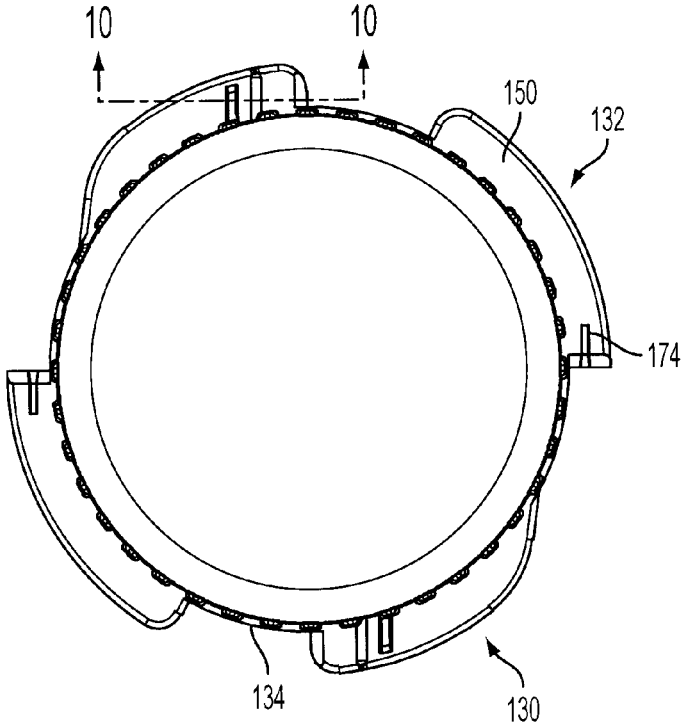
FIG. 9 is a top view of the cap of FIG. 7.

The cap 26 (FIG. 5) includes a sidewall 120 and a transverse web 122 at the upper end of the sidewall. The sidewall extends to a lower end/rim 124 and has an inboard surface 126 and an outboard surface 128. At an intermediate location along the sidewall, the sidewall bears radially outwardly protruding/projecting lugs. The exemplary lugs are formed as a first pair of diametrically opposed lugs 130 (FIG. 9) and a second pair of diametrically opposed lugs 132 offset from the first pair by 90°. The exemplary lugs project from a small flange 134.

In the exemplary cap, at the lower rim 124, the sidewall 120 protrudes outward to form a first sealing projection/lip 138 (FIG. 6). A second (upper) sealing projection/lip 140 is formed slightly below the flange 134. A plurality of vertical reinforcing ribs 142 depend from the lip 140 as branches thereof. These help keep the cap centered when installed. Although FIG. 6 shows the lip 138 interfering (an artifact of the computer aided engineering model that yielded FIG. 6) with the fitment inboard surface 80, the actual lip would be flexed by the engagement to provide a seal.

Figure 10:
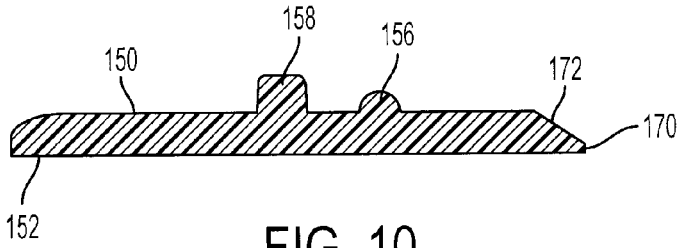
FIG. 10 is a sectional view of the cap of FIG. 9, taken along line 10-10.
Figure 11:
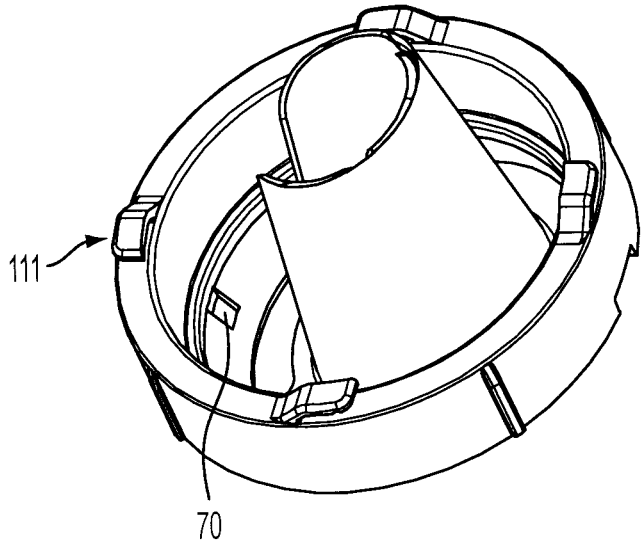
FIG. 11 is a view of a spout fitment of the assembly of FIG. 2.

The exemplary first and second lugs are different from each other. Each of the lugs has an upper surface 150 and a lower surface/underside 152 (FIG. 10). The upper surfaces of the exemplary first lugs 130 each include a first upward projection 156 and a second upward projection 158. The first upward projection 156 is relatively rounded and is positioned to cooperate with the arm recess 119 to detent the closed condition. The second projection 158 serves as a stop. For example, the cap may be installed via an initial downward translation toward the spout fitment. During this translation, the arms pass through spaces between the lugs. After initial seating of the lug undersides on the fitment upper wall, the cap is rotated (e.g., clockwise when looking downward). An exemplary rotation is 5-20°. Leading ends 170 of the lugs pass below the distal ends of the arms. The leading ends may have a camming surface 172 to engage the arm distal ends to facilitate passing. The first projections 156 may pass into receipt by the arm recesses 119. When this occurs or shortly thereafter, the second projections 158 may abut the arm distal ends to prevent further rotation. The exemplary second lugs 132 each include an upward projection 174. Relative to the exemplary projections 156 and 158, the projections 174 are circumferentially/tangentially elongate rather than radially elongate. The projections 174 add sufficient height to the second lugs so as to provide positive vertical engagement with the undersides of the associated arms when the cap is in the closed condition. This helps retain the cap. By making these projections 174 circumferentially/tangentially elongate, mold release may be simplified (e.g., because these projections 174 are parallel to the projections 156 and 158 rather than perpendicular thereto).

In an exemplary method of assembly, the cap is first installed to the spout fitment. The spout fitment is then installed to the bottle neck. This installation may involve screwing the spout fitment onto the bottle with the spout fitment thread 110 engaging the bottle thread 46. A terminal stage of this screwing may bring the lugs 52 into locking receipt with the recesses 102. The bottle may be filled with liquid prior to the spout fitment installation.

Various sealing features may be provided to respectively seal the cap to the spout fitment and the spout fitment to the bottle. In the exemplary embodiment, the cap lower sealing lip is positioned to engage an internal shoulder in the spout fitment sidewall 62 near the lower end thereof. The exemplary lip may be flexed near the internal apex of the shoulder. In the assembly views, parts are shown generated from a solid model and not reflecting strain. Accordingly, interference is shown which would produce strains. The upper lip sealingly engages the inboard surface of the sidewall 62 near the upper end thereof.

To seal the spout fitment to the bottle, a downwardly projecting lip 200 (FIG. 6) may depend from the underside 92 of the upper wall 88. A distal end of the lip 200 may engage the rim 38 and be flexed inward and upward in sealing engagement. As with the lip 138, FIG. 6 shows the lip 200 interfering with the bottle body, the actual lip 200 would be flexed upward and radially inward by the rim surface 38 to seal between the bottle body and the spout fitment.

Various implementations may have one or more of various advantages. One group of advantages may relate to the elimination of the spout internal thread. This may provide a cleaner appearance and provide a smoother drain-back flow (e.g., without detergent accumulating on the threads). In manufacture, a threading tool may be eliminated, thus simplifying manufacture. The bayonet lug-like fitting arrangement also provides a clear indication that the cap is in an installed condition (e.g., it is not visually easy to determine a slightly loose screw-on cap). The short range of rotational motion for opening (e.g., less than 90° compared with a full turn or more for a screw-on cap) may also present an ease of use. One group of advantages may relate to elimination of welding or adhering of the spout fitment to the bottle body. In addition to the economy of a saved step, this may facilitate delivery of the liquid before attaching the spout fitment to the bottle body which may allow more efficient processing (e.g., including higher flow delivery or less precisely aimed delivery through an opening in the bottle body larger than the spout opening). The spout fitments and caps may be delivered to the bottler as units and installed in units, thereby easing installation. Other potential advantages include weight reduction and reduced intrusion of the spout fitment into the bottle body (thereby permitting higher fill levels). Other potential advantages include improved sealing. Finally, there may be greater flexibility in aesthetics by permitting relatively easy use of differently-styled spout fitments with a given bottle body or differently styled bottle bodies with a given spout fitment.

One or more embodiments of the present invention have been described. Nevertheless, it will be understood that various modifications may be made without departing from the spirit and scope of the invention. For example, when implemented in the reengineering of an existing container configuration, details of the existing configuration may influence or dictate details of any particular implementation. Accordingly, other embodiments are within the scope of the following claims.

What is claimed is:

1. A bottle spout fitment and cap combination comprising:
a spout fitment (24); and
a cap (26) having:
a removed condition disengaged from the spout fitment; and
an installed condition mounted to and spout fitment, wherein:
the cap has a plurality of radially-protruding lugs (132);
the spout fitment comprises:
a spout (60); and
a plurality of channels (118) positioned to receive the lugs in the installed condition to block a longitudinal extraction of the cap from the spout fitment; and
the cap includes a lower portion below the lugs, the lower portion having:
an upper radially protruding sealing lip (140); and
a lower radially protruding sealing lip (138).

2. The combination of claim 1 wherein:
the lugs and channels form a detent mechanism detenting the closed condition.

3. The combination of claim 1 wherein:
the spout fitment comprises:
an intermediate wall (62);
a base wall (64) joining the intermediate wall to the spout to define a drain-back channel (66) surrounding the spout;
an internally threaded outer wall (94); and
an upper wall (88) joining the intermediate wall to the outer wall.

4. The combination of claim 3 wherein:
the channels are formed by arms extending from an upper surface of the upper wall.

5. A container (20) comprising:
a body (22) having a body opening (40); and
the combination of claim 1 wherein:
the spout fitment is within the body opening; and
the spout fitment and body have:
first interfitting features (110, 46) positioned to resist an extraction of the spout fitment from the body; and
second interfitting features (102, 52) positioned to angularly orient the spout fitment about an axis of the body opening.

6. The container of claim 5 wherein:
the first interfitting features comprise:
a first thread of the spout fitment; and
a second thread of the body; and
the second interfitting features comprise:
a recess in a sidewall of the spout fitment; and
a lug of the body.

7. The container of claim 5 wherein:
the first interfitting features comprise:
an internal thread of the spout fitment; and
an external thread of the body.

8. The container of claim 5 wherein:
the second interfitting features comprise:
a recess in a sidewall of the spout fitment; and
a lug of the body.

9. The container of claim 5 wherein:
the body consists essentially of HDPE;
the spout fitment consists essentially of polypropylene; and
the cap consists essentially of polypropylene.

10. The container of claim 5 wherein:
the fitment is neither adhered nor welded to the body.

11. The container of claim 5 further comprising:
1.0-6.0 liters of a liquid within the body.

12. A method comprising:
installing a spout fitment (24) into a neck portion (36) of a container body (22); and
installing a cap (26) onto the spout fitment by:
a longitudinal insertion wherein radially outwardly protruding lugs (132) on the cap pass into a first position circumferentially between channels (118) in the spout fitment; and
a rotation bringing the lugs into engagement with the channels.

13. The method of claim 12 wherein:
the installing of the cap is at least partially before the installing of the spout fitment.

14. The method of claim 12 wherein the installing of the spout fitment causes a recess (102) in the spout fitment to capture a lug (52) on the neck portion.

15. The method of claim 12 wherein:
the rotation consists essentially of a 5-20° rotation about a longitudinal axis.

16. The method of claim 12 wherein:
the rotation is detented.

17. The method of claim 12 wherein:
each of the channels (118) is formed by an associated arm (111) having:
a partially upwardly extending proximal portion (114); and
a circumferentially/radially extending distal portion (115).

18. The method of claim 12 wherein:
during the longitudinal insertion, undersides of the lugs seat against an upper wall of the spout fitment; and
the rotation passes leading ends of the lugs below the distal portions of associated said channels.

19. The method of claim 18 wherein:
the rotation causes first projections (156) to pass into associated detent recesses in lower surfaces of the associated arms and second projections (158) of the lugs to abut arm distal ends to prevent further rotation.

20. A bottle spout fitment and cap combination comprising:
a spout fitment (24); and
a cap (26) having:
a removed condition disengaged from the spout fitment; and
an installed condition mounted to and spout fitment, wherein:
the cap has a plurality of radially-protruding lugs (132);
the spout fitment comprises:
a spout (60);
a plurality of channels (118) positioned to receive the lugs in the installed condition to block a longitudinal extraction of the cap from the spout fitment;

an intermediate wall (62);

a base wall (64) joining the intermediate wall to the spout to define a drain-back channel (66) surrounding the spout;

an internally threaded outer wall (94); and an upper wall (88) joining the intermediate wall to the outer wall; and the channels are formed by arms extending from an upper surface of the upper wall.

21. The combination of claim 20 wherein:

each of said arms has:

a partially upwardly extending proximal portion (114); and a circumferentially/radially extending distal portion (115).

22. A bottle spout fitment and cap combination comprising:

a spout fitment (24); and a cap (26) having:

a removed condition disengaged from the spout fitment; and an installed condition mounted to and spout fitment, wherein:

the cap has a plurality of radially outwardly protruding lugs (132); and the spout fitment comprises:

a spout (60); and a plurality of channels (118) positioned to receive the lugs in the installed condition to block a longitudinal extraction of the cap from the spout fitment.

23. The combination of claim 22 wherein:

each of the channels (118) is formed by an associated arm (111) having:

a partially upwardly extending proximal portion (114); and a circumferentially/radially extending distal portion (115).

* * * * *